United States Patent [19]

Greene et al.

[11] 4,238,283

[45] Dec. 9, 1980

[54] POST-TREATMENT OF HUMIC ACID-DYED PAPER

[75] Inventors: Randall K. Greene; Willard A. Geiszler, Jr., both of Richmond, Va.

[73] Assignee: Philip Morris Incorporated, New York, N.Y.

[21] Appl. No.: 45,367

[22] Filed: Jun. 4, 1979

Related U.S. Application Data

[63] Continuation-in-part of Ser. No. 899,128, Apr. 24, 1978, abandoned.

[51] Int. Cl.[3] ..... D21H 5/16; D21H 1/46

[52] U.S. Cl. ..... 162/139; 8/919, 618, 646 131/15 R; 162/162

[58] Field of Search ..... 162/139, 158, 162; 131/15 R; 8/7

[56] References Cited

PUBLICATIONS

Chem. Abst., 34:567

Chem. Abst., 10:p972.

*Primary Examiner*—Peter Chin

*Attorney, Agent, or Firm*—Susan A. Hutcheson; Arthur I. Palmer, Jr.; George E. Inskeep

[57] ABSTRACT

Humic acid-dyed paper suitable for use as wrappers for smoking articles is post treated with magnesium sulfate to fix or render the humic acid insoluble. Paper treated in this manner provides a product of acceptable brown color. Smoking articles wrapped in the treated paper evolve a reduced amount of carbon monoxide on smoking under normal conditions in comparison to currently available brown papers stained with humic acid.

5 Claims, No Drawings

POST-TREATMENT OF HUMIC ACID-DYED PAPER

TECHNICAL FIELD

This is a continuation-in-part of U.S. Ser. No. 899,128 filed Apr. 24, 1978, abandoned.

The invention relates to improved methods for staining papers suitable for use as wrappers for smoking articles wherein alkali humates are utilized. The humates are rendered insoluble on the paper using solutions of magnesium sulfate.

BACKGROUND OF THE PRIOR ART

The use of humic acid and fractions thereof as dyes is well known. ("Recent Progress in the Chemistry of Natural and Synthetic Coloring Matters," T. S. Gore et al. eds., Academic Press, N.Y. 1962, pps. 99–112.) Recently, a variety of cigarettes manufactured with brown paper wrappers have enjoyed increased popularity among smokers, and some of these cigarettes are fabricated using brown wrappers stained with humic acid. Processes for staining cigarette paper brown have included the use of dyes such as synthetic azo dyes, dyes produced from walnut shells, caramel, tannic acid and the like. However, the aforementioned stains or dyes are undesirable for a variety of reasons. First, the azo dyes, which contain large amounts of nitrogen, may produce undesirable pyrolysis products and, therefore, could be unsuitable for use in smoking articles. Secondly, the amount of caramel required to produce the desired intensity of brown color considerably inhibits the burn rate of the paper. The use of such stains as tannic acid may provide the desired brown color; however, treatment of this type simultaneously reduces the porosity of the paper thereby also reducing the rate of combustion. In addition, adverse affects on the gas phase composition are also noted (see Austrian Pat. No. 175,148).

By definition, humic acids are allomelanins found in soil, peat, and low-rank coal. They are generally alkali soluble and precipitated in the presence of acids. From a chemical standpoint, humic acids generally consist of a mixture of complex macromolecules characterized as having polymeric phenolic structures with the ability to chelate with metals. In addition, humic acids have a strong base-binding power, and this ion-exchange capability can be used advantageously in their use as dyes. There are many variations of humic acid depending upon differences in the plant remains from which they originate as well as the soil, climate, microflora, drainage, etc.

Humic acids, by nature, are intensely chocolate brown in color; and because of their natural origin, they are particularly preferred over synthetic dyes as staining pigments for producing brown wrappers or papers for smoking products. Generally, an alkaline solution is prepared by mixing the powdery humic acid with an alkali metal hydroxide, i.e., sodium hydroxide, to form a soluble humate salt. This solution is used to impregnate the paper on one or both sides, and this is followed by a fixing step, generally with salts such as aluminum, calcium, iron, chromium and the like. In essence, sodium ions are partially exchanged for the other metal ions added in the fixing process, thus leaving a water insoluble humate salt on the paper.

Henning in *Allgemeine Papier-Rundschau,* No. 31:1027 (21 August 1967) describes methods for staining paper, and especially paper suitable for cigarette wrappers, with Sap Brown (also termed "nut stain" or humates) at about neutral pH. The Sap Brown may be rendered insoluble on the paper by fixing with aluminum or iron sulfate. We have found that certain disadvantages are encountered when utilizing the foregoing method of Henning. For instance, when aluminum sulfate is employed as the fixing agent, an undesirable white masking of the rich brown color is observed. When iron sulfate is used as the fixing agent, and the paper is ultimately used for smoking products, a brown ash forms on smoking. It is generally recognized that a grey to white ash is more preferable, particularly from an appearance standpoint.

German Pat. No. 957,361 discloses dyeing methods for yellow straw with an alkali humate solution. The humate is fixed on the straw by means of iron or chromium salts such as, for example, $FeSO_4.7H_2O$ or $[CrCl_2(H_2O)_4]Cl\text{-}2(H_2O)$. Iron is unsuitable for the aformentioned reasons. The use of chromium salts in smoking products would be undersirable because of their well established toxicity. See, for example Dangerous Properties of Industrial Materials, N. Irving Sax, Fourth Edition, 1975 pages 558–9.

Others have suggested that various cations are useful for precipitating humates, and they include lead, copper, calcium, potassium, and the like. However, none have suggested that the cations mentioned would be suitable for use as a fixing agent when staining paper for ultimate use in smoking articles. Moreover, no suggestion has been made to indicate that a particular cation, magnesium when used as a fixing agent, might be preferable for use in smoking articles due to improved smoking characteristics, improved appearance, or lowered gas phase constituents on smoking.

Austrian Pat. No. 175148 to Ringer discloses the use of various acids in combination with cigarette paper to effect a denicotinization of the smoke. The porosity of the paper is decreased by Ringer's method, and the addition of salts, such as magnesium sulfate, apparently reduced the porosity to an even greater extent thereby resulting in a more significant reduction of nicotine in the smoke.

We have observed that a post-treatment of humate stained paper with magnesium sulfate has little effect on nicotine delivery or reduced porosity. These observations will be described in detail hereinbelow.

Analytical studies using humic acid-treated brown wrappers have indicated in some instances a tendency toward increased gas phase constituents. Various attempts have been made to reduce constituents, such as carbon monoxide, by using more efficient filter elements, by increasing the degree of ventilation in filters, or by increasing the porosity of the paper or wrapper, etc. However, none of these methods has proven to be entirely satisfactory.

BRIEF SUMMARY OF THE INVENTION

This invention concerns the improvement of humic acid-treated paper or sheet material in which tobacco or any other smoking product is rolled for the fabrication of cigarettes, cigars, or the like.

The invention relates specifically to a process for treating humic acid-dyed brown paper suitable for use as wrappers for smoking articles wherein some of the products of pyrolysis are substantially reduced. In studies with cigarettes made with commercially available humic acid-stained papers, it was observed that on pyrolysis the burning papers produced more carbon monoxide than conventional white cigarette wrappers. In an effort to identify the cause, experiments were designed to study a number of parameters related to dyeing with humic acid. The concentration and composition of humic acid was varied as well as the pH of the staining solution; and in addition, a variety of cations (fixing agents) that render the humic acid insoluble and colorfast on the paper, were utilized in an attempt to reduce gas phase delivery. From the results obtained, a total system has been developed for coating cigarette wrappers having reduced gas phase constituents on smoking and this system will be described in detail hereinbelow.

Thus, it is an object of this invention to provide a method for producing a humic acid-coated paper or smoking wrapper whereby smoking articles produced from said paper can be materially improved.

It is a further object of this invention to provide methods and means that individually operate to provide a more desirable brown paper or wrapper from the standpoint of gas phase delivery whereby such gas phase constituents, such as carbon monoxide, are substantially reduced.

It is yet a further object of this invention to provide a method for fixing humates on paper whereby a desirable color intensity is obtained with a concomitant reduction in gas phase constituents such as carbon monoxide.

Other objects and advantages will be discussed and described in detail hereinbelow.

DETAILED DESCRIPTION OF THE INVENTION

In the practice of the present invention, commercially available humic acid is suspended in water with stirring. The mixture is then centrifuged to recover the insoluble humic acid, and the acid-soluble materials are discarded. Experimentation indicates that the acid-soluble fraction is undesirable in that at certain concentrations there is a tendency towards gel formation, and, in addition, this fraction does not appreciably improve color depth or intensity of the final staining solution.

The acid-insoluble humic acid fraction is generally dried, weighed, and then suspended in water. The pH of the suspension is adjusted with a base such as sodium, potassium, or ammonium hydroxide, with sodium hydroxide being preferred. The final pH of the staining solution should be between about 7 and 8 for optimum results. There appears to be a tendency towards increased carbon monoxide delivery as the pH of the staining solution is increased over about a pH of 8. Stabilization of the pH of the solution may require about 8 to about 20 hours with continual stirring.

Just prior to the actual staining or dyeing of the paper, the alkaline humate solution may be centrifuged to remove any remaining insoluble materials. The insoluble materials are dried and weighed. The staining solution containing the alkali humate is adjusted by the addition of water to give a final concentration of about 12 to 16% humate and preferably about 14% humate by weight.

The actual staining process may be carried out utilizing a conventional size press wherein standard bobbins of cigarette paper are passed through a staining bath containing the alkali humte at a predetermined speed to insure that the desired amount of staining solution is retained on the paper. The paper may be stained on one or both sides depending on the desired effect to be achieved.

In an alternate approach, sodium humate is added to a slurry of purified cellulose pulp, and the slurry is used as a furnish in a conventional papermaking machine to produce a brown paper suitable for use in the fabrication of smolking products.

In a preferred embodiment of the present invention, the alkali humate is fixed on the paper by treatment with a dilute solution of magnesium sulfate. This salt post-treatment is preferably carried out after the paper has been stained and dried by conventional methods. although calcium salts are well known fixing agents for alkali humates, we have found magnesium sulfate unexpectedly superior for use as a fixing agent when preparing paper for ultimate use in smoking articles. Magnesium sulfate at a concentration of about 1 to 3%, and preferably about 2% by weight, provided consistently lower carbon monoxide delivery when compared to calcium chloride or magnesium acetate. Tests were conducted using aluminum sulfate as a fixing agent; and although carbon monoxide deliveries were acceptable, it was noted that at even the lowest concentration possible for fixing the alkali humate, the aluminum salt caused an unacceptable white film on the paper, thereby masking the rich brown color of the humate stained paper.

Following the fixing step, the paper may be washed with water to remove excess magnesium sulfate or alkali sulfate salts, i.e., sodium sulfate, which is formed during fixing. If a post-washing step is employed, it is necessary to use a more concentrated solution of magnesium sulfate for fixing, for example, a 3 to 5% solution of magnesium sulfate would be acceptable. This washing step is preferably carried out using a conventional size press as previously described. The insoluble magnesium humate remains on the paper and, after drying, is color fast and provides an acceptable paper for use in smoking articles. An acceptably intense brown color is obtained using the salt post-treatment of the present invention while maintaining a lowered carbon monoxide delivery.

The following examples are illustrative but are not intended to be limitive thereof.

EXAMPLE 1

Studies were conducted to compare different salts for use in fixing sodium humate stained papers. Conventional white cigarette paper was stained with a sodium humate solution having a pH of 12.7. The stained paper was dried and separate pieces were treated with one of the following solutions: 5.0% calcium chloride, 4.9% magnesium acetate, or 5.5% magnesium sulfate. Increased concentrations of fixing solutions were used to assure that some of the sodium ions would be displaced or exchanged by either magnesium or calcium ions. The humate-stained papers were fixed by immersion in the fixing solution using a conventional size press.

Following the fixing step with the above-named solutions, the stained and fixed papers were dried. Cigarettes containing a typical blend of tobacco were fabricated at 85 mm lengths. All of the cigarettes had conventional cellulose acetate filters attached thereto.

The cigarettes were smoked under controlled laboratory conditions and the gas phase that passed through the filters was trapped and analyzed for carbon monoxide using known infrared spectroscopy techniques. Nicotine delivery was measured using standard methods well known in the art. Cigarettes fabricated from paper that had not been treated by fixing with a calcium or magnesium salt served as controls. The results are tabulated in Table 1 below.

Table 1

| | SALT POST TREATMENT | | | | |
|---|---|---|---|---|---|
| | Salt | CO/Puff | P.C.+ | CO/cigt (mg) | Nicotine/cigt (mg) |
| *85 mm cigarettes | Control | 3.37 | 9.0 | 30.3 | 1.36 |
| | 5.0% $CaCl_2$ | 3.09 | 9.3 | 28.8 | 1.36 |
| | 4.9% MgAc | 3.44 | 9.0 | 31.0 | 1.41 |
| | 5.5% $MgSO_4$ | 2.64 | 9.3 | 24.6 | 1.34 |

*Stained with Na Humate Ph 12.7
+Puff count

The data indicate that the papers treated with 5.5% magnesium sulfate resulted in reduced carbon monoxide delivery when compared to the untreated control and the other salts shown above.

EXAMPLE 2

Cigarette Paper was stained with sodium humate having a pH of 10.0. The paper was dried and fixed with one of the following solutions: 5% $CaCl_2$, 5.5% $MgSO_4$, and 10% HCl. Cigarettes were fabricated as in Example 1 and smoked under controlled laboratory conditions. The gas phase was trapped and analyzed according to the method previously disclosed. The total particulate matter and nicotine were trapped on cambridge filter pads and measured using standard procedures. The porosity of the control and treated papers were determined using a modified Greiner Water Porosity Device. The porosity of the paper was determined by the length of time necessary to draw 50 ml of air through a 0.786 inch area. The air flow was induced by a falling water column, and the time for 50 ml of air to pass through the sample area was measured by the time required for the water level to pass between two electrodes, the equivalent of 50 ml. The determinations were made under carefully controlled laboratory conditions at about 24° C. and 60% r/h. The results are tabulated in Table 2.

Table 2

| SALT POST-TREATMENT 85 mm Cigarettes Na Humate, pH 10 | | | | |
|---|---|---|---|---|
| Salt | PC* | CO/cigt. (mg) | Nicotine mg/cigt | Porosity (sec) |
| control--no salt | 8.5 | 20.5 | 1.35 | 27.0 |
| 5% $CaCl_2$ | 9.8 | 25.0 | 1.44 | 20.0 |
| 5.5% $MgSO_4$ | 8.5 | 20.4 | 1.33 | 21.0 |
| 10% HCl | 10.0 | 32.0 | 1.50 | 21.0 |

*PC = puff count

Although the salts shown above are acceptable in rendering the sodium humate insoluble, use of magnesium sulfate as the fixing agent results in a more acceptable carbon monoxide delivery rate.

EXAMPLE 3

The sodium salt of sap brown, obtained from Abbey Chemical Company, was dissolved in water to give a final concentration of 20% by weight. Conventional white cigarette paper was stained with the sap brown solution and dried. Separate pieces of the dried paper were fixed using either a 5% solution of calcium chloride or a 5.5% solution of magnesium sulfate.

Cigarettes (85 mm) were fabricated using the prepared papers. Control cigarettes were prepared using stained but unfixed paper. Cellulose acetate filters were attached and the cigarettes were smoked and the gas phase analyzed as in Example 1. The nicotine delivery and porosity were determined as described in Example 2.

Table 3

| Paper | CO/Puff | CO/cigt. (mg) | Nicotine (mg) | TPM (mg) | Porosity (sec) |
|---|---|---|---|---|---|
| Control | 3.35 | 26.8 | 1.21 | 27.5 | 23 |
| $CaCl_2$--fixed | 3.37 | 23.6 | 1.21 | 26.7 | 21 |
| $MgSO_4$--fixed | 2.43 | 21.9 | 1.22 | 25.8 | 27 |

EXAMPLE 4

Technical grade humic acid (Aldridge Chemical Company) was washed extensively with tap water until the supernatant liquid became clear. Approximately 4% of the acid soluble material was removed. The humic acid was then treated with 1% by weight sodium hydroxide. The pH of the mixture was 5.0. Extensive washing resulted in a 20% weight loss, which represented additional acid soluble materials.

The washed humic acid weighing 350 g was then treated with 21 g sodium hydroxide in three steps. At each step, the solution having a pH of 7–8 was centrifuged, and the supernatant liquid was decanted, dried at 50° C., and weighed. The separated sodium humate was combined with an additional wash of the insoluble residue and dried to yield about 160 g. This represented approximately 32% of the starting material.

The dried sodium humate was dissolved in water to give a final concentration of 15% (W/V). Following centrifugation to remove insolubles, the humate solution was 13.7% (W/V). The solution was coated on conventional cigarette paper by means of a size press. The paper was dried and post treated with a 2% (W/V) solution of magnesium sulfate. Unstained white cigarette paper was also treated in a similar manner with 2% magnesium sulfate.

Cigarettes, (120 mm) fabricated using a conventional blend of tobaccos, were wrapped with the treated papers. Cellulose acetate filters were attached to the cigarettes. Cigarette A was wrapped with untreated white paper; Cigarette B was unstained paper treated with magnesium sulfate; Cigarette C was stained with humic acid; and Cigarette D was stained with humic acid and post-treated with magnesium sulfate.

The cigarettes were smoked under controlled laboratory conditions and analyzed as described in Examples 1 and 2. The results are as follows.

Table 4

| | PC* | CO/cigt. (mg) | CO/Puff | Nicotine mg/cigt | Porosity (sec) |
|---|---|---|---|---|---|
| Cigarette A control | 11.9 | 13.5 | 1.13 | 0.86 | 14.0 |
| Cigarette B control + $MgSO_4$ | 11.8 | 14.6 | 1.24 | 1.01 | 14.0 |
| Cigarette C humate stained | 13.4 | 24.4 | 1.82 | 1.26 | 16.0 |
| Cigarette D humate + $MgSO_4$ | 13.6 | 22.6 | 1.66 | 1.27 | 14.0 |

*PC = puff count

We claim:

1. A method of preparing an improved humic acid-dyed paper for use as a wrapper for smoking articles, which method comprises the steps of (1) contacting humic acid solids with water at a pH of about 5–7 to dissolve acid-soluble material, and recovering the remaining insoluble humic acid solids; (2) resuspending the recovered insoluble humic acid in water and adjusting the pH of the aqueous medium to about 7–8 with alkali hydroxide to effect dissolution of the humic acid and provide an alkali humate solution; (3) dyeing paper with the alkali humate solution; and (4) fixing the humic acid-dyed paper with a solution of magnesium sulfate.

2. A method in accordance with claim 1 wherein the alkali humate is sodium humate.

3. A method of preparing an improved humic acid-dyed paper for use as a wrapper for smoking articles, which method comprises the steps of (1) contacting humic acid solids with water at a pH of about 5–7 to dissolve acid-soluble material, and recovering the remaining insoluble humic acid solids; (2) resuspending the recovered insoluble humic acid in water and adjusting the pH of the aqueous medium to about 7–8 with alkali hydroxide to effect dissolution of the humic acid and provide an alkali humate solution; (3) dyeing paper with the alkali humate solution; (4) fixing the humic acid-dyed paper with a solution of magnesium sulfate; and (5) washing the fixed paper with water to remove excess magnesium sulfate or alkali sulfate salts.

4. A method in accordance with claim 1 wherein the alkali humate is sodium humate, and the alkali sulfate is sodium sulfate.

5. An improved paper for use as wrappers of smoking articles prepared according to the method of claim 1.

* * * * *